US005180283A

United States Patent [19]

Vickery, III

[11] Patent Number: 5,180,283

[45] Date of Patent: Jan. 19, 1993

[54] MANUAL TWO-STAGE AIR PUMP

[76] Inventor: Earle R. Vickery III, 7301 Don Diego NE., Albuquerque, N. Mex. 87109

[21] Appl. No.: 726,388

[22] Filed: Jul. 5, 1991

[51] Int. Cl.[5] ..... F04B 33/00; F04B 21/04

[52] U.S. Cl. ..... 417/234; 417/262

[58] Field of Search ..... 417/234, 260, 262, 520, 417/534, 259, 261; 482/72, 73, 112, 114, 115, 120; 92/137

[56] References Cited

U.S. PATENT DOCUMENTS

| | | | |
|---|---|---|---|
| 1,820,883 | 7/1929 | Hueber | 417/534 |
| 2,443,344 | 6/1948 | Ekleberry | 417/261 |
| 3,233,554 | 6/1963 | Huber | 417/534 |

FOREIGN PATENT DOCUMENTS

| | | | |
|---|---|---|---|
| 0139401 | 3/1948 | Sweden | 417/260 |

*Primary Examiner*—Richard A. Bertsch
*Assistant Examiner*—Roland McAndrews
*Attorney, Agent, or Firm*—James E. Eakin; Janet Kaiser Castaneda

[57] ABSTRACT

A manually operated pump includes a pulley sheave oppositely wound with cord and rotatably mounted on a support element, a two-stage pump, and a reciprocal action shaft. The shaft is mounted eccentrically through the assembled pump, including through a clearance hole and slot in a main piston of the pump. The pump is a cylinder with a double-ended piston slidably mounted within and forming a main chamber at each end of the cylinder. An offset high pressure piston extends into the main chamber from each cylinder end for operation with offset high pressure chambers defined in each end of the double-ended piston. Passageways with differential air pressure valves lead from the slot to the main chambers, from the main chambers to the high pressure chambers, and from the high pressure piston to outlets. The user's rectilinear pulling motion on the pulley cords is translated into alternating rotary motion at the pulley sheave, the rotary motion is translated into alternating linear motion at the eccentric common shaft, and the linear motion eccentrically placed with regard to the axis of rotation causes the shaft to move in a sinusoidal pattern around and against the sides of the main piston slot thereby causing the main piston to reciprocate. The second stage compression in the high pressure chambers/pistons operates as the pressure at the device to be inflated exceeds the pressure of the first stage compressed air.

21 Claims, 14 Drawing Sheets

MANUAL TWO-STAGE AIR PUMP

FIELD OF THE INVENTION

The invention relates to manually operated air pumps. More specifically, the invention is a compact and portable, manually operated two-stage pump. The invention finds special application for compressing and delivering air to high pressure bicycle tires of enhanced performance bicycles.

BACKGROUND OF THE INVENTION

Manually operated air pumps are known in the art. By "pump" is meant a device which causes fluid flow and which preferably compresses a gaseous fluid and delivers it under pressure to an enclosed vessel or space. By "air" is meant any gas and most preferably ambient air. Hand pumps frequently require the user to press against a handle or similar device to compress trapped air via a cylinder and force it to pass through a hose which is attached to the device for which compressed air is required. A one-way valve is often employed at the device to prevent exit of the compressed air. Hand operated pumps are generally one stage pumps and air is typically drawn into the pump when the user pulls up on the handle. One stage hand operated pumps are not particularly difficult to use when the device to be filled is empty and the user is pushing against ambient or air pressure. A continuing drawback of hand operated pumps becomes immediately apparent when the user attempts to press against a high back pressure which is present, for example, near the end of a filling operation or to "top-off" an already inflated device. The higher the existing back pressure cf the compressed air already within the device to be filled, the greater the physical force required by the user to drive the pump and complete the task.

Serious cyclists use light-weight, tubular thin-walled tires for racing or extended touring. Because the tubular tires are vulnerable to punctures and other road damages, cyclists may carry spare tires which may be mounted and used until the damaged tire can be repaired. A tubular tire may be inflated at pressures frequently above 120 pounds per square inch and ranging from 45 pounds per square inch to 135 pounds per square inch, depending upon the riding conditions. In addition, it may be necessary to vary the pressure during a particular excursion.

Hand-operated air pumps are frequently carried by cyclists for the inflation of bicycle tires. The pumps must be compact, portable and light weight. Conventional reciprocating pumps have been adapted for use by cyclists. The reciprocating pumps operate with a small volume cylinder and a small diameter piston displacing very limited air volumes and requiring considerable time to inflate the tire. Those small displacement compressors result in a considerable amount of muscular energy being expended. The most compact of these prior pumps uses rather uncomfortable muscular exertion, particularly pushing motions, to achieve compression of the air. It is difficult to achieve pressures at the upper end of the inflation pressure scale with known hand operated pumps.

As can be seen from the discussion of the prior art, an unsolved need exists for a manually operated pump having simple mechanical structures for rapidly and easily converting relatively non-strenuous muscular effort to useful high pressure compressed air.

SUMMARY OF THE INVENTION WITH OBJECTS

A general object of the present invention is to provide a hand operated pump that overcomes the drawbacks of the prior art.

A specific object of the present invention is to provide a compact, portable hand-powered pump to translate human energy into mechanical energy in a useful form.

Another specific object of the present invention is to provide an apparatus to convert comfortable, alternating pulling action into a reciprocating motion having a significant mechanical advantage.

A further specific object of the present invention is to provide a hand-powered air pump capable of achieving high compression pressures quickly and comfortably.

One more specific object of the present invention is to provide a simple, reciprocal pump mechanism that produces high compression from rotary motion in both of the two recurring directional senses.

Yet another object of the present invention is to provide an easily manufactured, rugged hand pump that will provide many years of useful service with minimum maintenance.

Still one more object of the present invention is to provide a small, light-weight manual air pump that may be permanently attached to a bicycle during both transportation and use and may be used to inflate high pressure bicycle tires.

Still another specific object of the present invention is to provide a two-stage pump requiring only a manual pulling action to produce high pressure compressed air.

In accordance with the principles of the present invention a manually operated two-stage pump is provided having a generally circular shape and comprised of two circular pulley sheaves with cord pulleys, a central mounting support, a two-stroke pump, and a reciprocal action shaft.

The central mounting support is two generally cup-shaped, essentially identical elements, with each element having an outer flange and a window opening extending through and across the bottom of the cup-shaped element. The two elements are mounted oppositely to each other, flange to flange, thereby forming the central mounting support and a seat for the pump between the window openings. A race having bearings encircles the outside surface of each element for mounting ball bearings and the circular pulley sheaves.

The sheaves are mounted on the assembled central support and keyed to a common shaft that passes through the first sheave, through the window opening in the first half of the support, through a clearance hole in a main cylinder of the pump, through a slot in a main piston of the pump, through the window opening in the second half of the assembled support, and through the second sheave. The shaft is mounted so as to be eccentric to the axis of rotation of the sheaves. A mounting plate fits over each end of the common shaft and a clip device is used to secure the position of the common shaft in a keyway in the plate.

The sheaves are oppositely wound with cord so that pulling and unwinding one cord of the first sheave causes the second cord to be rewound on the second sheave. The oppositely wound sheaves enable the user to alternately pull each cord in a smooth and continuous operation without the necessity for a separate rewind cycle.

The main cylinder is a cylindrical tube having an access hole passing through the body of the cylinder for the entry of atmospheric pressure air, for access to the slot of the main piston installed therein, and for the passage of the common shaft through the cylinder. The ends of the main cylinder are circular plugs that are press fit into open ends of the main cylinder. Each plug defines an inner, non-concentric offset high pressure piston extending into the main cylinder and having a passage therethrough containing a valve. Each plug further defines an outer surface having a recess which bears a nipple attachment for an exit hose from the high pressure piston passage.

The main piston is a double-ended reciprocating tube with the slot for the common shaft passing through the center of the piston. When mounted in the main cylinder, a main chamber is created at each end of the main cylinder. Each end of the main piston defines a complementary, offset, non-concentric high pressure chamber for operation in conjunction with the high pressure pistons. A passageway leads from each of the main chambers to the high pressure chamber at the opposite end of the main cylinder.

The pump is operated as follows: The user stabilizes the pump, generally by placing his or her foot through a pump strap and applying body weight on the strap to hold the pump in position. The user then grasps a pullel, cord with each hand and pulls one cord upwardly with one hand and arm while the user's other hand and arm moves downwardly as the second cord is rewound. The two-phase, up and down, rectilinear pulling motion of the user on the pulley cords is translated into mechanically advantaged rotary motion a& the pulley sheaves. The rotary motion of the pulley sheaves is alternating with each pulling phase and is translated into alternating linear motion at the eccentric common shaft. As the shaft is alternatively rotated in first one direction and then in the opposite direction, its eccentric placement with respect to the axis of the sheaves causes the shaft to move in a cycle defining a sinusoidal pattern of motion around and against the sides of the slot in the main piston. As the shaft moves through the cycle around and against the sides of the piston slot, the further mechanically advantage force applied on the slot causes the main piston to reciprocate and to compress ambient air in one of the main chambers of the main cylinder. Ambient air is drawn into the second end main chamber of the main cylinder through the passage leading from the slot. As the piston begins to reciprocate, compressed air in the first stage is forced at a higher pressure through the narrow passageways leading from the first end chamber to the high pressure cylinder forming a second compression stage. The high pressure piston then forces compressed air in the second stage at a higher pressure through the hole in the high pressure piston and into the hose carrying the second-stage compressed air to the device to be inflated. As the cycle is ending, the main piston is beginning compression at the second end chamber. The valves of the passages are operated by differential air pressure so that first stage compressed air may flow directly to the device to be inflated where the air pressure at the device is less than that of the first stage pressure.

In another aspect of the present invention, ball valves are used throughout the two-stroke pump and two sets of races and ball bearings are included for rotation of a single pulley sheave. In this aspect, the two-stage pump is generally tubular in shape.

These and other objects, aspects, advantages and features of the present invention will be more fully understood and appreciated upon consideration of the following detailed description of a preferred embodiment, presented in conjunction with the accompanying drawings.

BRIEF DESCRIPTION OF THE DRAWINGS

FIGS. **14*a* through 14*d* show the main components of the two-stage pump prior to assembly, including the main cylinder in 14*b*, the main piston in 14*c*, and the two end plugs in 14*a* and 14*d*.

FIGS. **15*a*–15*h* are sectional views of the two stage pump showing the location of the working pistons within the cylinders as the common shaft completes a full cycle of rotation around the piston slot, and corresponding sectional air movement views showing compression and movement of the air into and between the chambers and into the exit hoses.

DETAILED DESCRIPTION OF A PREFERRED EMBODIMENT

Figure 1:
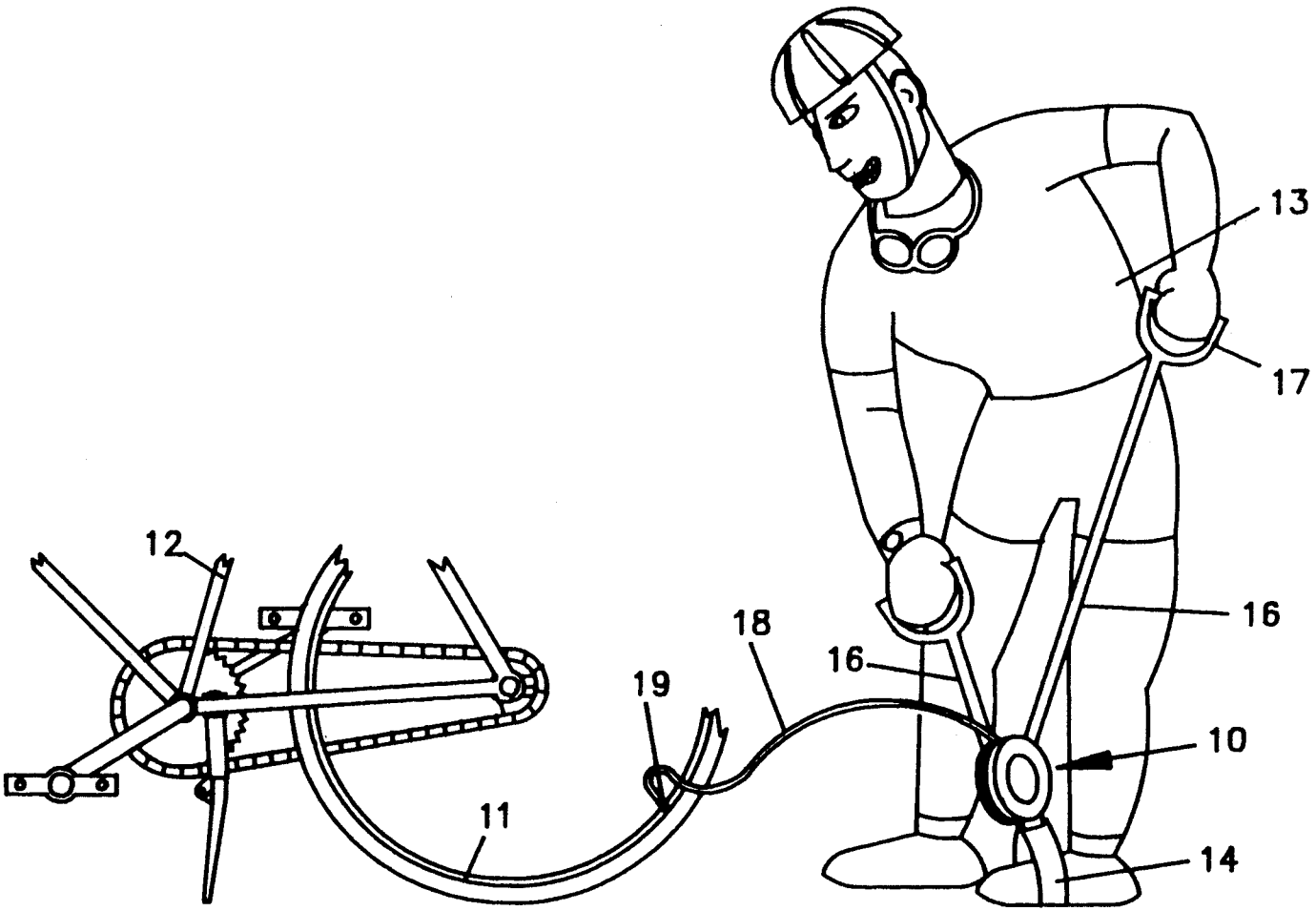
FIG. 1 shows the application of the present invention to a portable bicycle pump for high performance bicycle tires.
Figure 2:
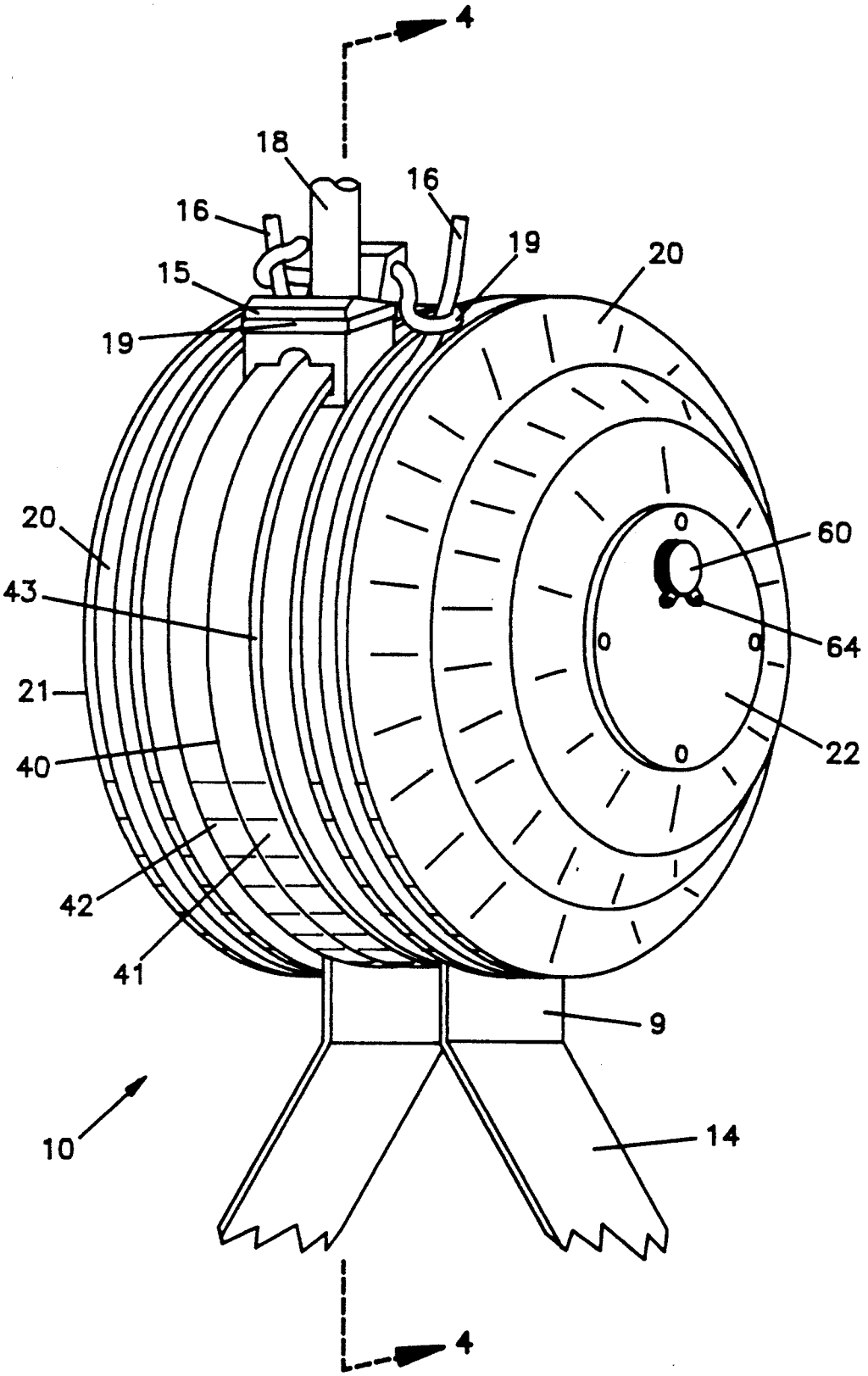
FIG. 2 is a perspective view of the main external elements of the invention.

Although the present invention has wide and general application for energy conversion, the presently conceived best mode of carrying out the invention is described below in connection with its use as a hand-operated air compressor. The pump, shown generally as reference numeral 10 in FIG. 1, is being used to fill the high pressure tire 11 of an enhanced performance bicycle 12. The operator 13 is stabilizing the pump 10 with the weight of his body by placing his foot through and on a strap sling 14 which is attached to the pump 10. The operator 13 is alternately pulling upwardly on pulley cords 16 to which handles 17 have been attached for ease of operation. A high pressure hose 18 extends from an outlet of pump 10 to an air inlet fitting 19 of tire 11.

Referring now to FIGS. 2 through 5, the generally circular pump 10 is formed by the assembly of two pulley sheaves 20 mounted on the outside of a central support 40 which is formed from two essentially identical pieces 41 and 42 mounted oppositely to each other, a common shaft 60 passing therethrough, and a two-stroke compressor 80 having a double-ended reciprocating piston 100.

Figure 11:
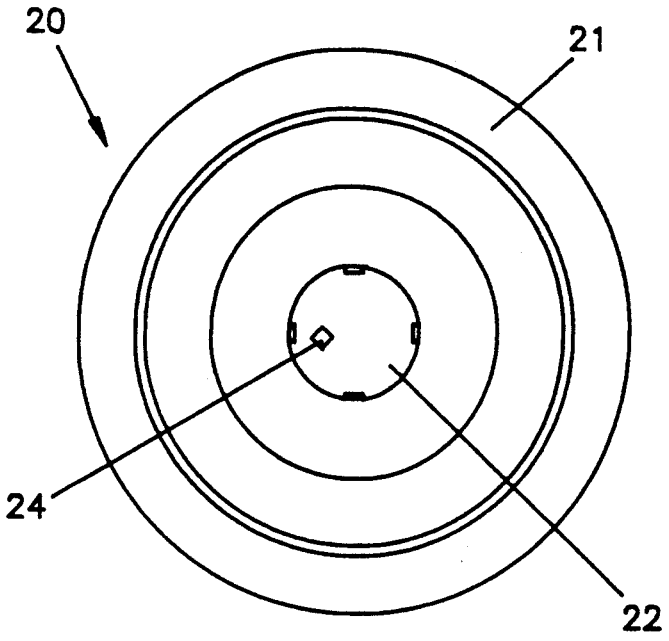
FIG. 11 is a top plan view of the outer surface of the sheave showing the offset mounting of the central shaft.
Figure 12:
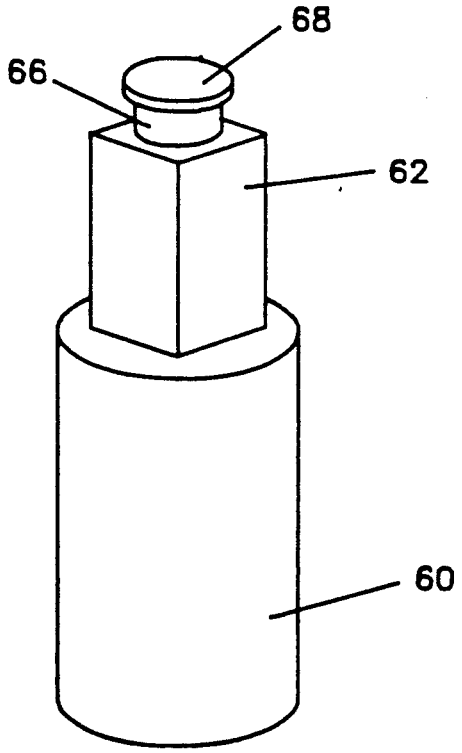
FIG. 12 is a perspective view in elevation of an end of the common shaft.
Figure 13:
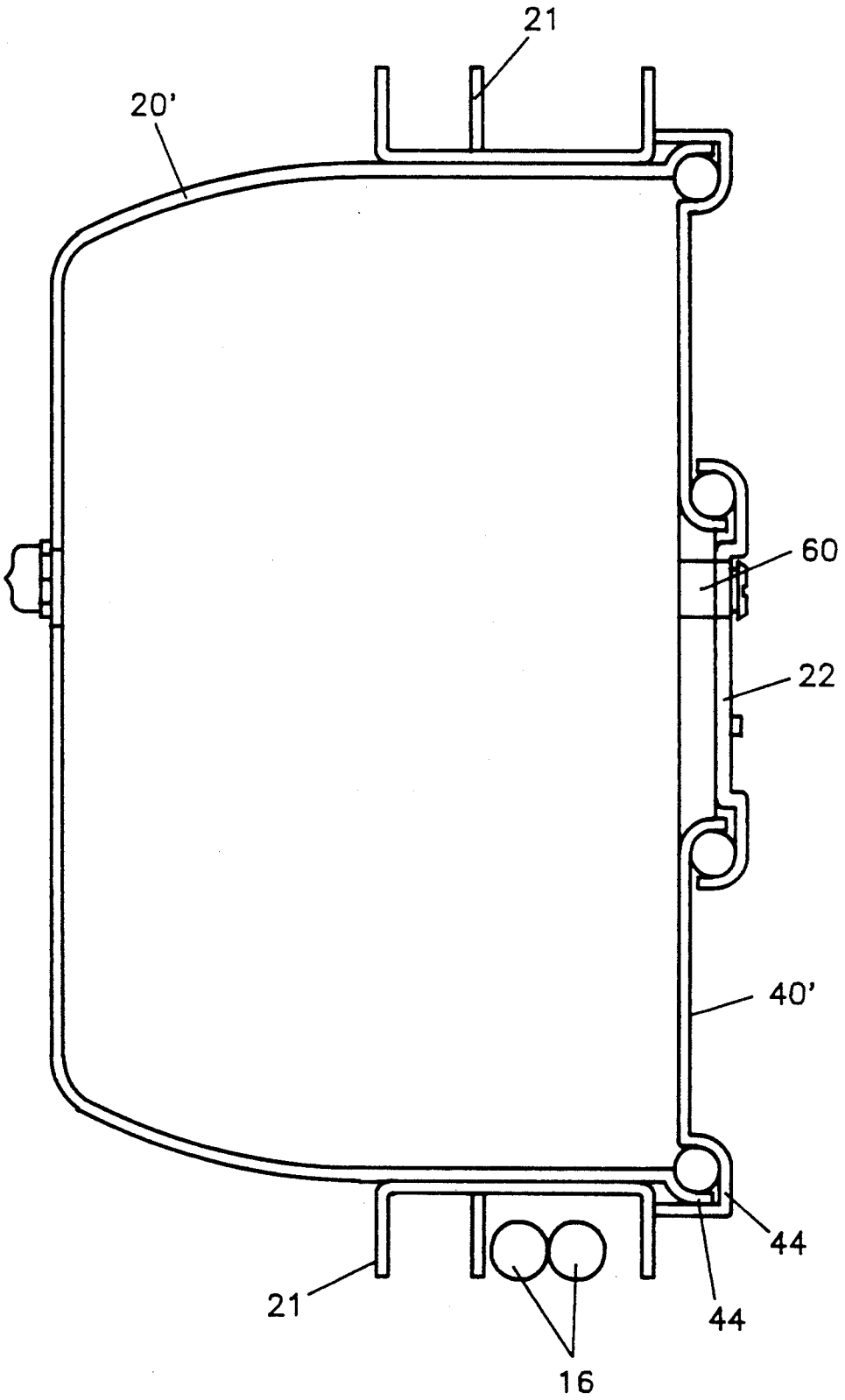
FIG. 13 is a side view of another aspect of the present invention showing an alternative design for a single sheave and bearings for rotation of the sheave.

The generally cup-shaped pullay sheaves 20 are constructed from anodized aluminum or similar metallic materials or suitable plastic materials, and each sheave defines a pair of parallel flanges 21 between which pulley cords 16 are oppositely wound. The cords 16 may be fastened to the pulley sheave by passing an end of the cord 16 through a hole in an outermost sheave flange and tying a knot in the end of the cord. Referring now to FIGS. 11 and 12, a metallic mounting plate 22 snap mounts to the outside central surface of each sheave 20. The mounting plates 22 and the sheaves 20 each define a mating, generally square keyway, opening 24 which is offset from the axis of rotation of the sheaves 20. The generally square keyway openings 24 mount a generally square keying portion 62 on each end of the cylindrical central shaft 60 thereby stabilizing the eccentric position of central shaft 60 with respect to the axis of rotation of the sheaves 20. An E-clip 64, shown in FIG. 10, or other comparable fastening device such as a ring clip, is placed around a neck portion 66 of each end 68 of the common shaft 60. The inside surface of each sheave 20, as best seen in FIG. 10, is provided with one half of an encircling race 24 for rotation on the central support 40.

Figure 3:
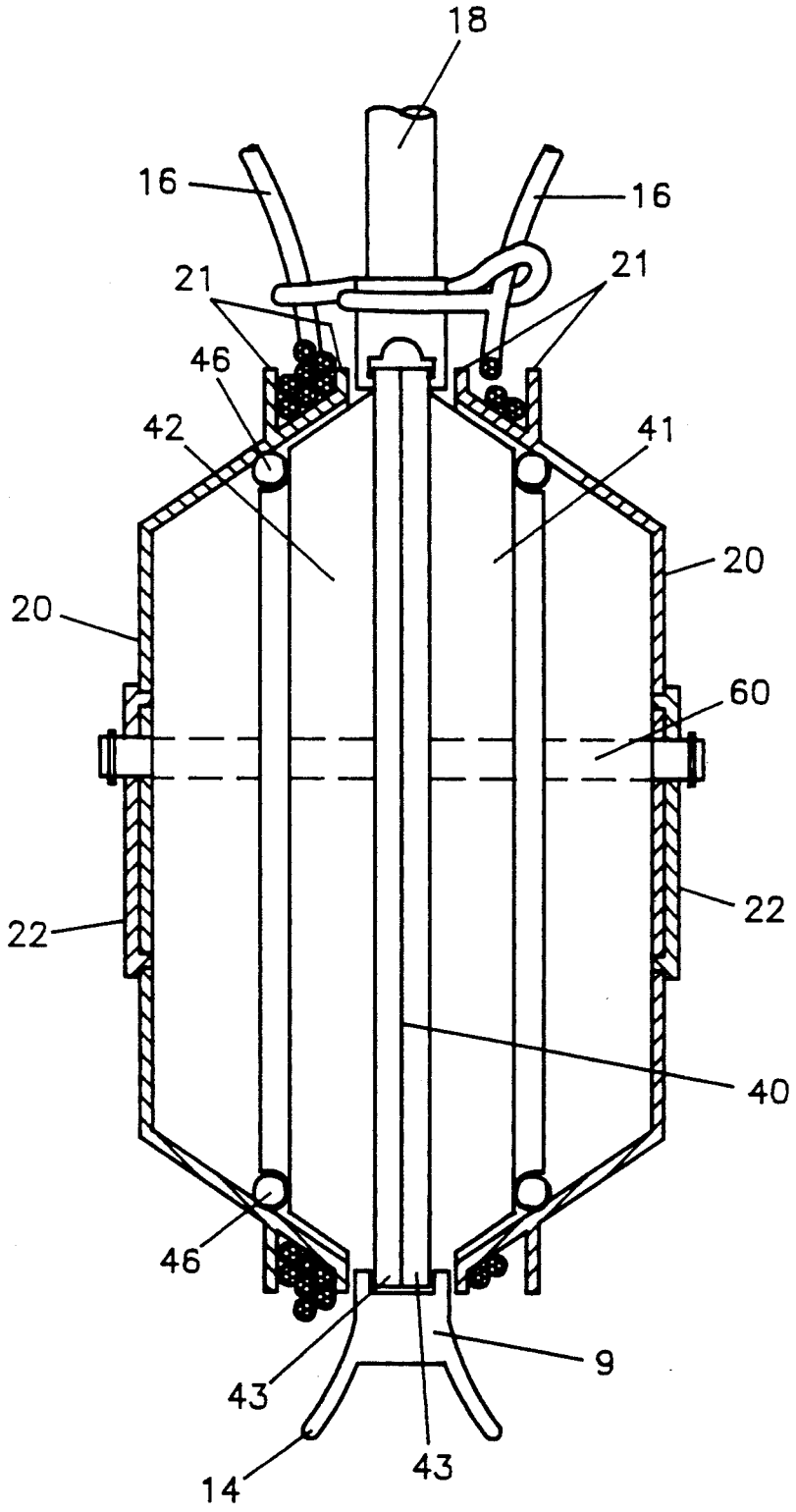
FIG. 3 is a cross-sectional view taken along lines 4—4 of FIG. 2.
Figure 4:
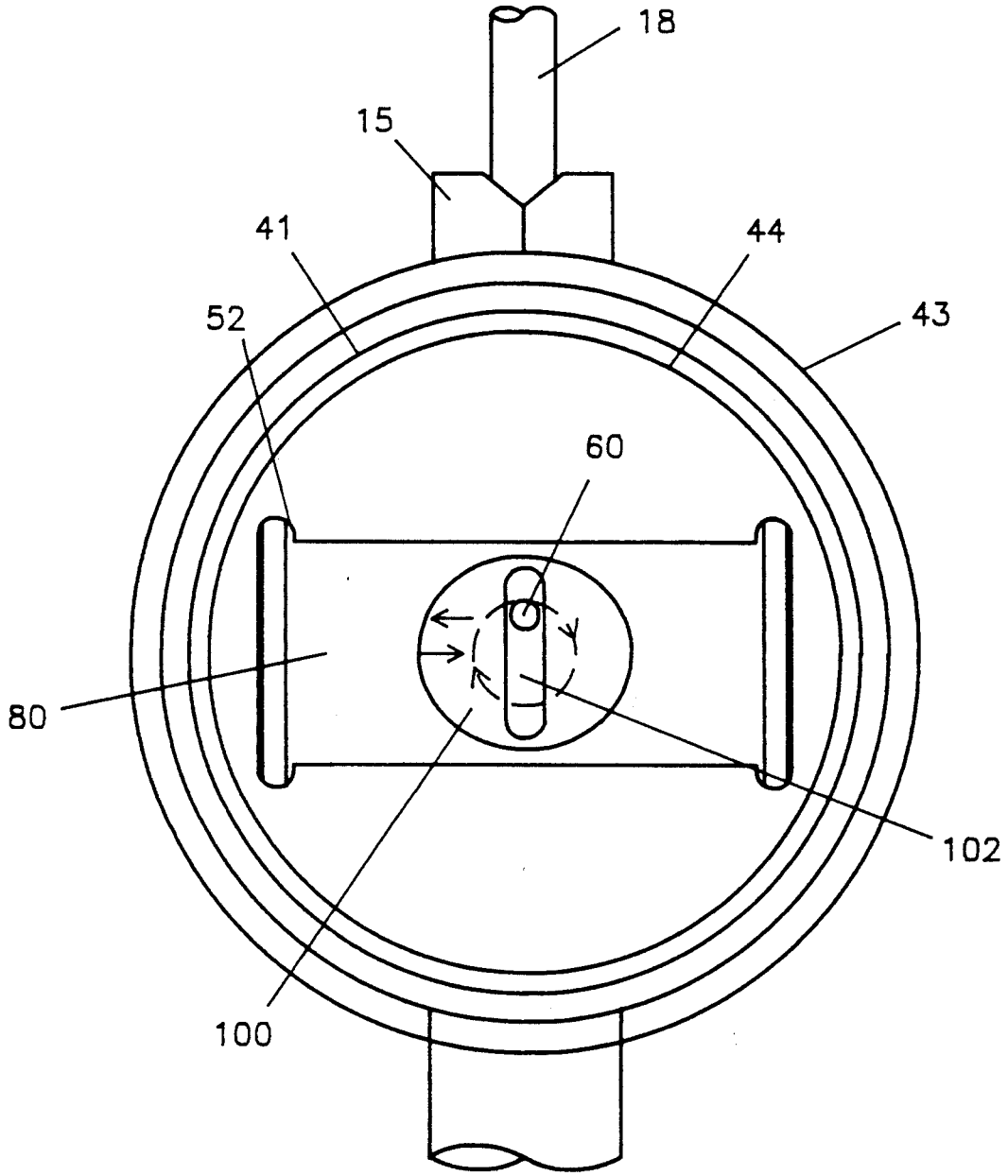
FIG. 4 is an end view of the present invention with the sheave removed and showing the central support for attaching the sheave, the rectangular opening, the cylinder, the cylinder opening, the piston slot, and the central shaft within the piston slot.
Figure 10:
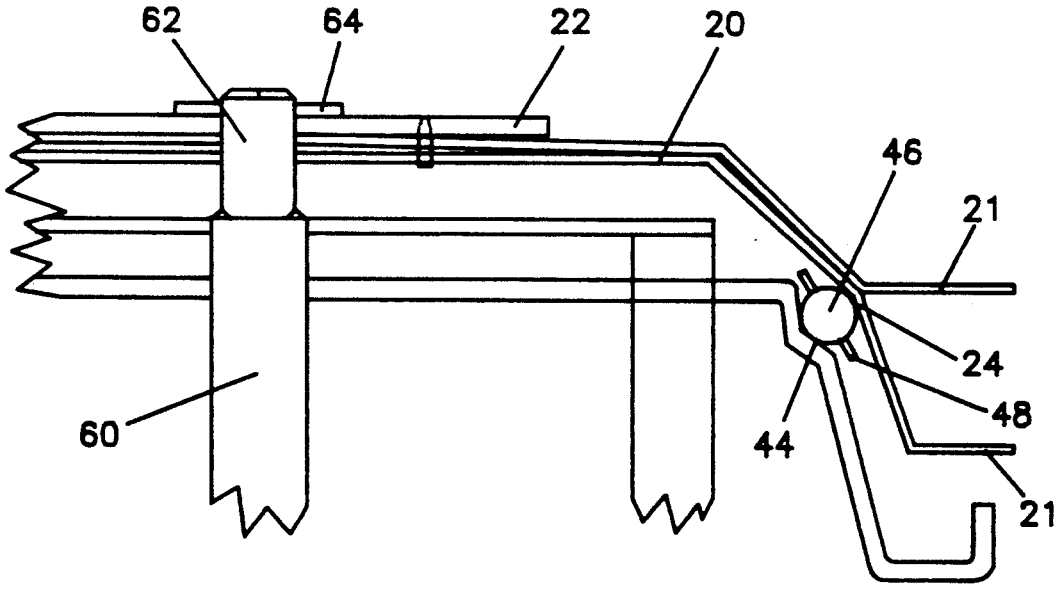
FIG. 10 is sectional view of the sheave mounted on the support and showing the race and bearing for rotation of the sheave.

Referring now to FIGS. 3, 4 and 10, the generally cup shaped central support 40 is formed by oppositely mounted pieces 41 and 42. Pieces 41 and 42 are preferably constructed from anodized aluminum or other suitable substances, and each defines an outer flange 43. The central support 40 is formed by mounting pieces 41 and 42 flange to flange. The contiguous flanges 43 provide a convenient gripping point for the user when handling the pump 10. The mating flanges may be held together with conventional clamping devices, such as a duplex clamp 15 which further provides support and protection for the high pressure hose 18. The clamp 15 may also be provided with cord guides 19 for cords 16. The strap 14 may be attached to the central support 40 by a similar clamp 9. The high pressure hose 18 exits from the pump 10 through a notch (not shown) formed in the mating flanges 43 of the central support 40. As best shown in FIG. 10, the outer surface of each piece of the central support 40 defines the other half of the encircling race 44 corresponding to the race 24 of the inner surface of the sheaves 20. A complete race is forced upon mounting the sheaves 20 on the central support 40, and the sheaves 20 thereby rotate freely upon the central support 40. Ball bearings 46 and spacers 48 are positioned in the mating races 24 and 44 for rotation of sheaves 20. As best seen in FIG. 4, each piece 41 and 42 defines a shaped and generally rectangular window having both short opposite ends 52 extended in length. The two-stage compressor 80 is mounted in the interior of central support 40, bearing the piston 100. The central shaft 60 is shown passing through the piston 100.

Figure 5:
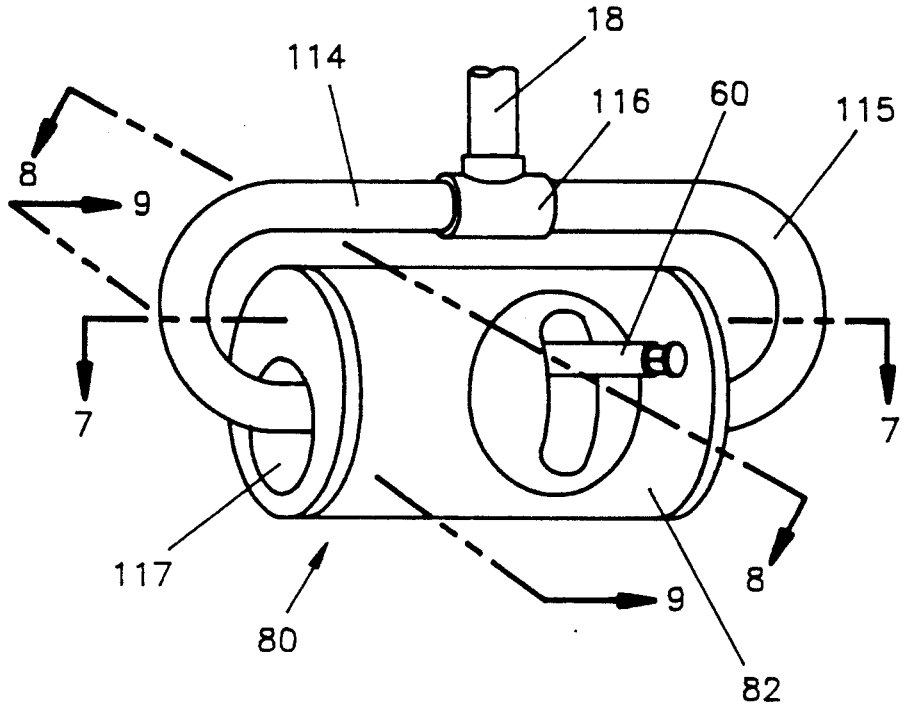
FIG. 5 is a perspective view in elevation of the two stage pump showing the T-shaped hose attached to each end of the main cylinder.
Figures 14A, 14B, 14C, 14D:
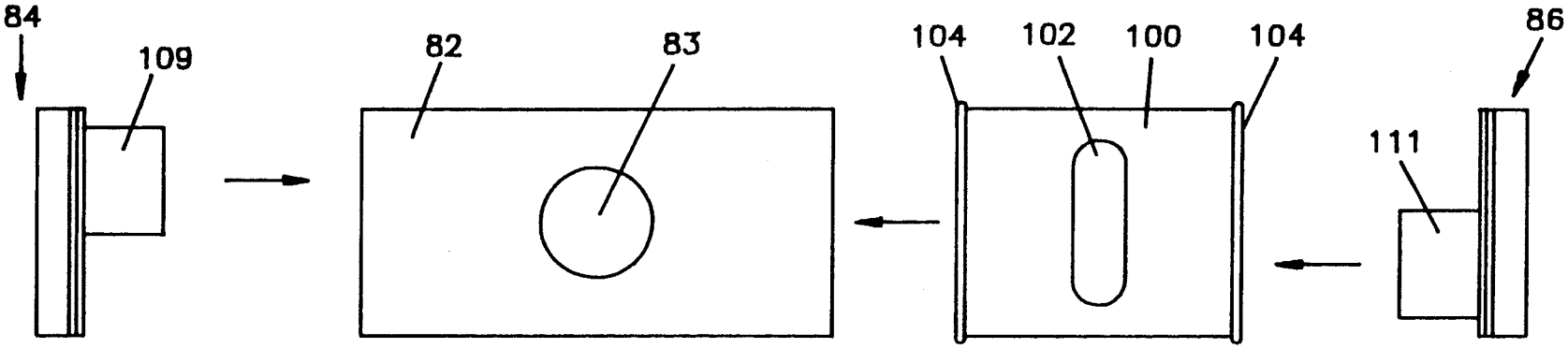
FIG. 14*e* is an end view of the interior mounting surface of an end plug showing the secondary piston and exit air passage.
FIG. 14*f*** is an end view of the exterior of an end plug showing the attachment device for the exit air hose.
Figure 14F:
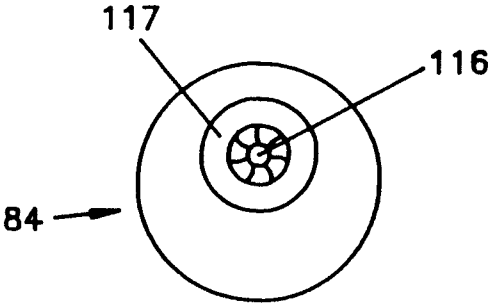
Figure 14E:
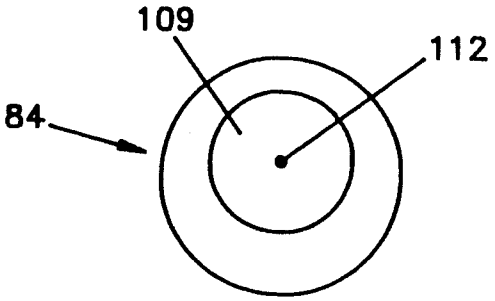

Referring now to FIGS. 5 and 14, the two-stroke compressor 80 is assembled from the following components: a main cylinder 82, a first and a second main cylinder end plug 84 and 86, and the double-ended piston 100 slidingly engaged within main cylinder 82.

The main cylinder 82 is a cylindrical, open-ended tube having an access hole 83 passing through the body of the cylinder 82. The access hole 83 permits the entry of ambient air into the two-stage compressor 80 and further enables the common shaft 60 to be mounted through the pump 10.

Figure 6:
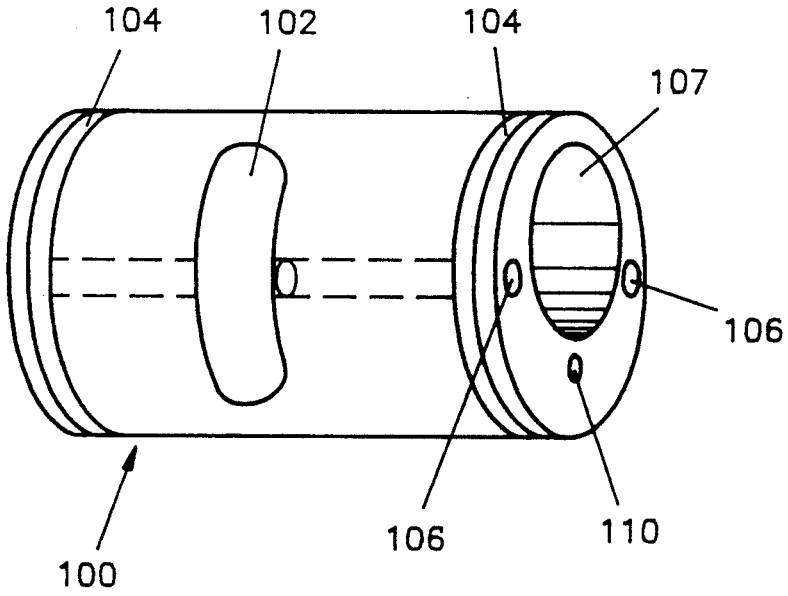
FIG. 6 is a perspective view of the main piston showing the piston slot and the passages to ambient and to the secondary cylinders (not shown).
Figure 7:
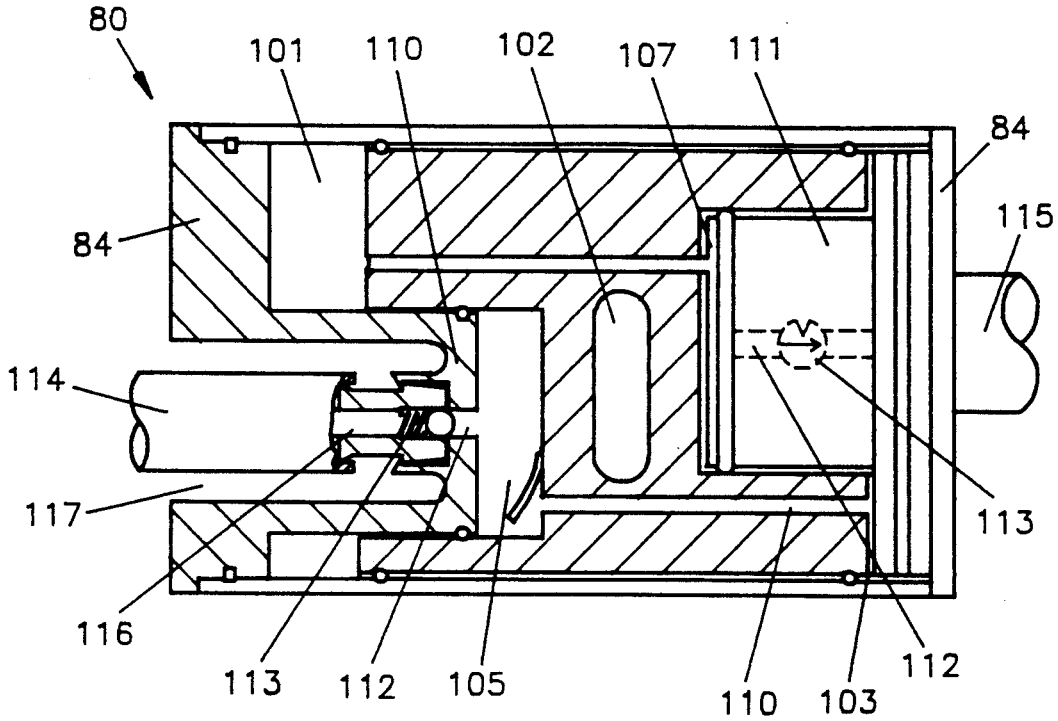
FIG. 7 is a sectional view of the two stage pump taken along the lines 7—7 of FIG. 5.
Figure 8:
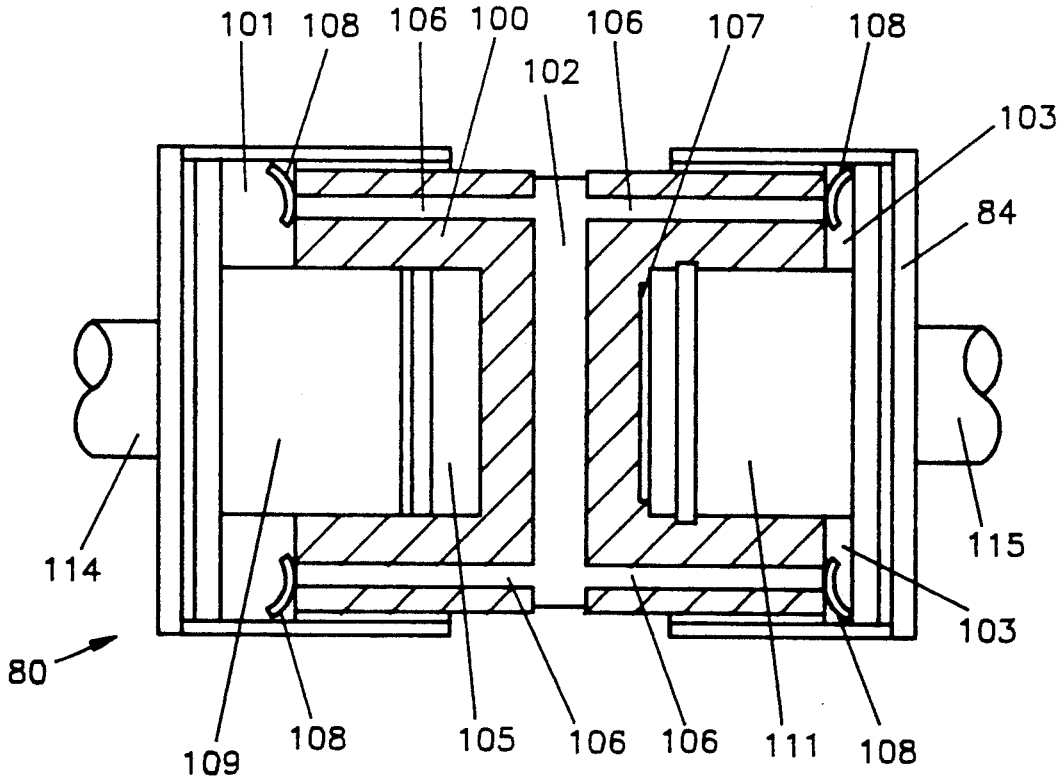
FIG. 8 is a sectional view of the two stage pump mechanism taken along the lines 8—8 of FIG. 5.

As best seen in FIGS. 6, 7, 8 and 9, the double-ended piston 100 is slidingly mounted within the main cylinder 82. The piston 100 is a generally tubular body having a central slot 102, essentially rectangular, therethrough for engagement with the common shaft 60. Each end of the piston 100 defines one or more O-rings 104 to provide a sealing engagement of the piston 100 with the inner wall of the main cylinder 82, as best seen in FIGS. 6 and 8. When centrally mounted inside of the main cylinder 82, the piston 100 creates a first main chamber 101 and a second main chamber 103 at each end of the main cylinder 82. As best seen in FIG. 8, ambient air inlet passages 106 extend from the central slot 102 to main chambers 101 and 103. A single air inlet passage may be used. One-way check valves 108, or relatively low pressure leaf valves are provided at the entrance to each main chamber 101 and 103.

As best seen in FIGS. 6 and 7, each head of the piston 100 is provided with a secondary, offset generally cylindrical high pressure chamber 105 and 107, hereinafter HPchambers 105 and 107. A secondary high pressure piston, 109 and 111 hereinafter HPpistons, is formed on each end plug 84 and offset so as to fit within mating offset HPchambers 105 and 107 thereby providing a second stage of compression. As best seen in FIG. 7, at least one first stage air passage 110 leads from each main chamber 101 and 103 to HPchambers 105 and 107 on the opposite end of the main piston 100. One-way check valves 108, or relatively higher pressure leaf valves than the valves provided from ambient to the main chambers, are also provided at the entrance to HPchambers 105 and 107 to control the flow of the first stage compressed air into the HPchambers.

Referring now to FIGS. 5, 7, **14*e* and 14*f*, exit air passages 112 are formed through HPpistons 108 and and controlled by ball and spring check valves 113. Exit passages 112 each connect with one arm, 114 and 115, of high pressure delivery hose 18. Referring to FIGS. 7 and 14*f*, arms 114 and 115 connect to exit passages 112 at the nipple extensions 116 formed in recesses 117 in the outer surfaces of end plugs 84. Flared or barbed fittings (not shown) having annular rings defined on the outside surface, are provided to create a relatively air-tight passage for the exiting high pressure air. Arms 114 and 115 connect to hose 18 at a Tee-junction 116**. Alternatively, the tee-junction may be attached to the barbed fitting (not shown).

Figure 9:
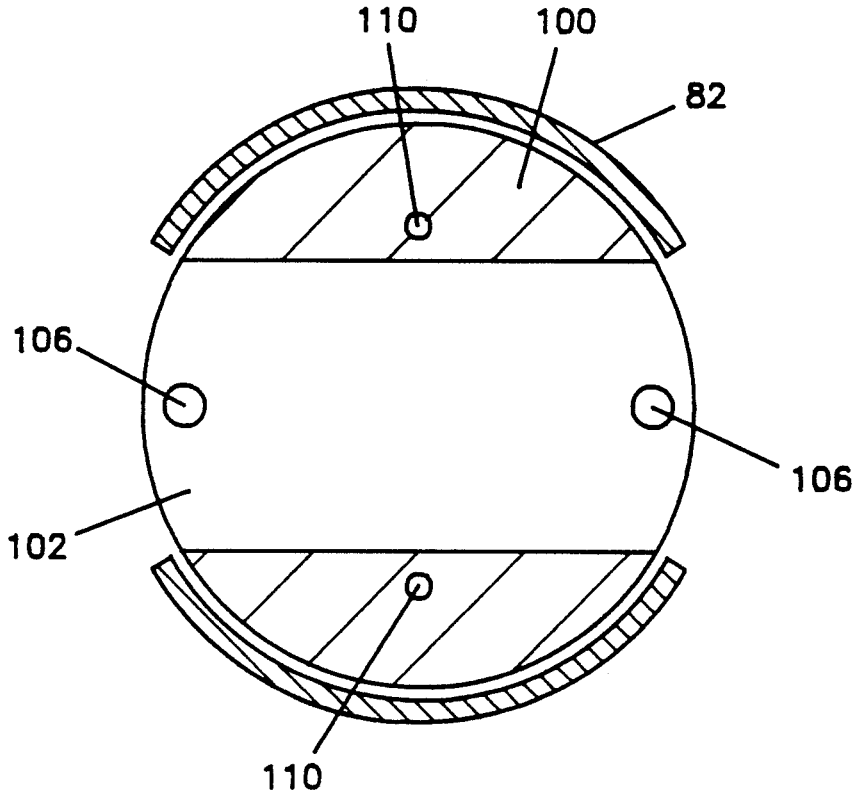
FIG. 9 is a sectional end view cf the two stage pump mechanism taken through the lines 9—9 of FIG. 5.

The cross-sectional view in FIG. 9 shows the distribution of the air passages through the main piston 100. Passages 106 communicate with ambient air in slot 102. The non-concentric, offset position of passages 110 for the delivery of first stage compressed air are isolated from ambient air and extend through the body of the main piston 100. The formation of the passages 106 is facilitated by the eccentric and opposed positions of the HPpiston/chamber assemblies. As seen in FIGS. 7 and 8, the passages may all be drilled straight through the main piston body without encountering any cavity but the desired one.

All contact joints may be sealed by the provision of conventional "O"-rings, such as those numbered 104 at the end of the main piston 100 and additionally at end plugs 84.

Referring now to FIGS. 15*a* through 15*h*, a complete cycle of working pump 10 is shown in conjunction with air flow diagrams. The cycle includes a complete revolution of common shaft 60 around the outside of slot 102 and a complete reciprocation of main piston 100 from left to right within main cylinder 82. As the user grasps a handle attached to each cord with each hand, he or she pulls upwardly on one cord with one hand and arm as the opposite hand and arm move downwardly while the opposite cord rewinds. This two-phase, alternating rectilinear pulling force to the cords of the pulley sheaves is translated into mechanically advantaged rotary motion at the pulley sheaves. The alternating rotary motion at the pulley sheaves is translated into alternating linear motion at the attached and eccentrically placed common shaft 60. The alternating linear motion at the eccentric common shaft is translated into a further mechanically advantage force describing a sinusoidal pattern of motion of the shaft 60 around the sides of piston slot 102. As the shaft 60 presses against the sides of the slot 102 during its cycle of revolution around the slot, the main piston 100 reciprocates in the main cylinder 82. Beginning at FIGS. 15*a* and 15*b*, the shaft 60 is in approximately the middle of slot 102 and the main piston 102 has reached the end of the left main chamber 101. Ambient air is drawn in through slot 102 and into right main chamber 103. Simultaneously, first stage compressed air from left main chamber 101 is forced through air passages 110 into HPchamber 107, and high pressure air is exiting through exit passage 112 as HPchamber 105 reaches its right-most position relative to HPpiston 109.

Figure 15A:
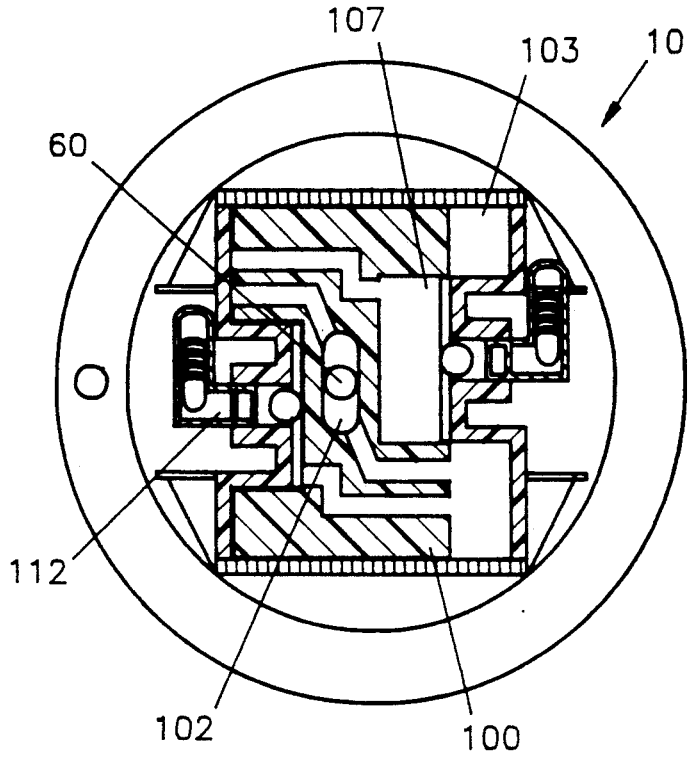
FIGS. 15*a* and 15*b* show the left stop position of the main piston and the corresponding movement of air.
Figure 15B:
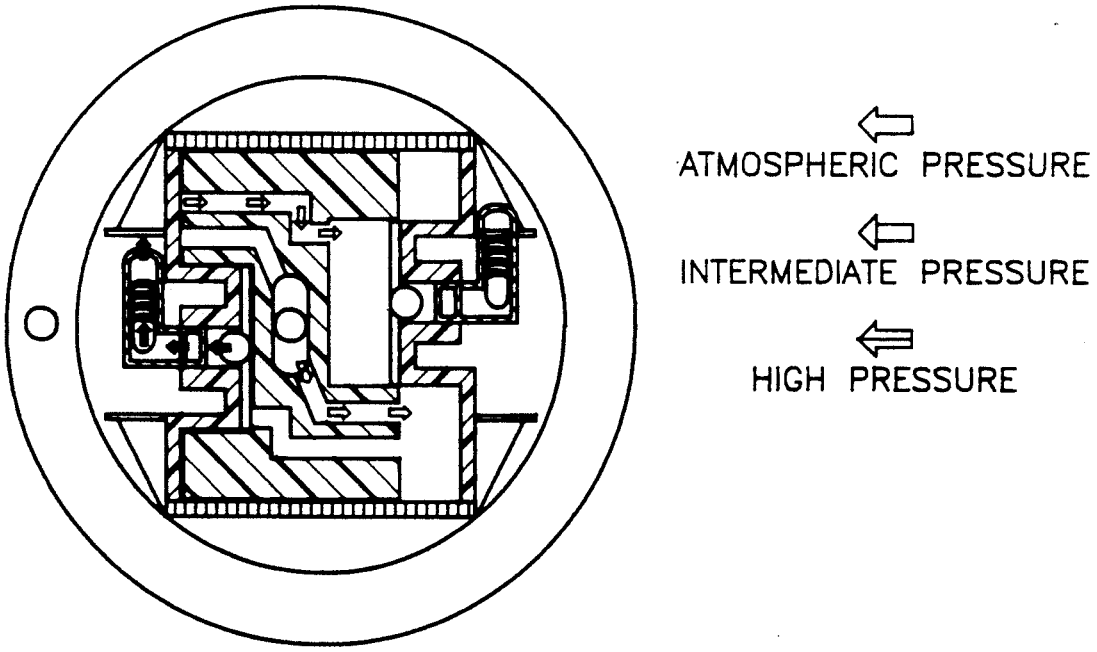
Figure 15C:
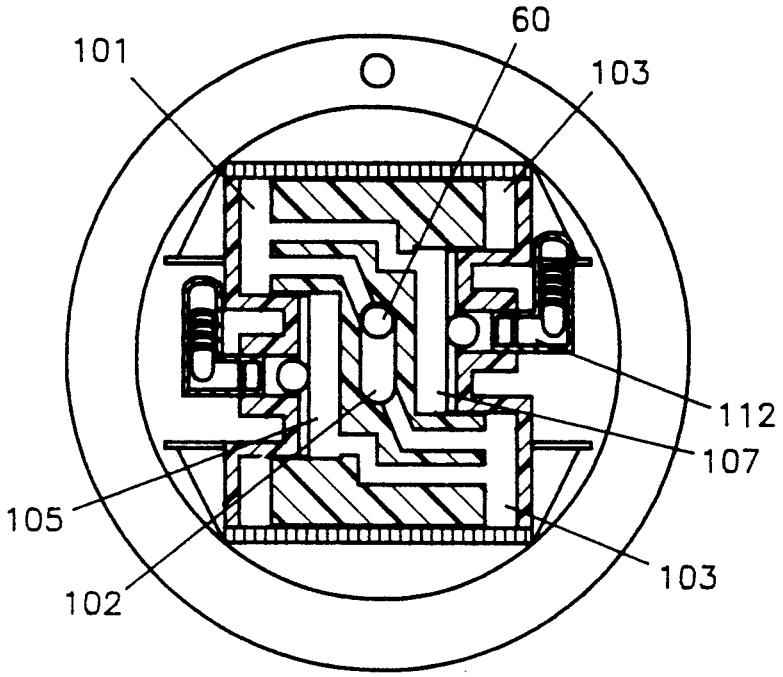
FIGS. 15*c* and 15*d* show the mid point of right piston movement and the corresponding air movement.
Figure 15D:
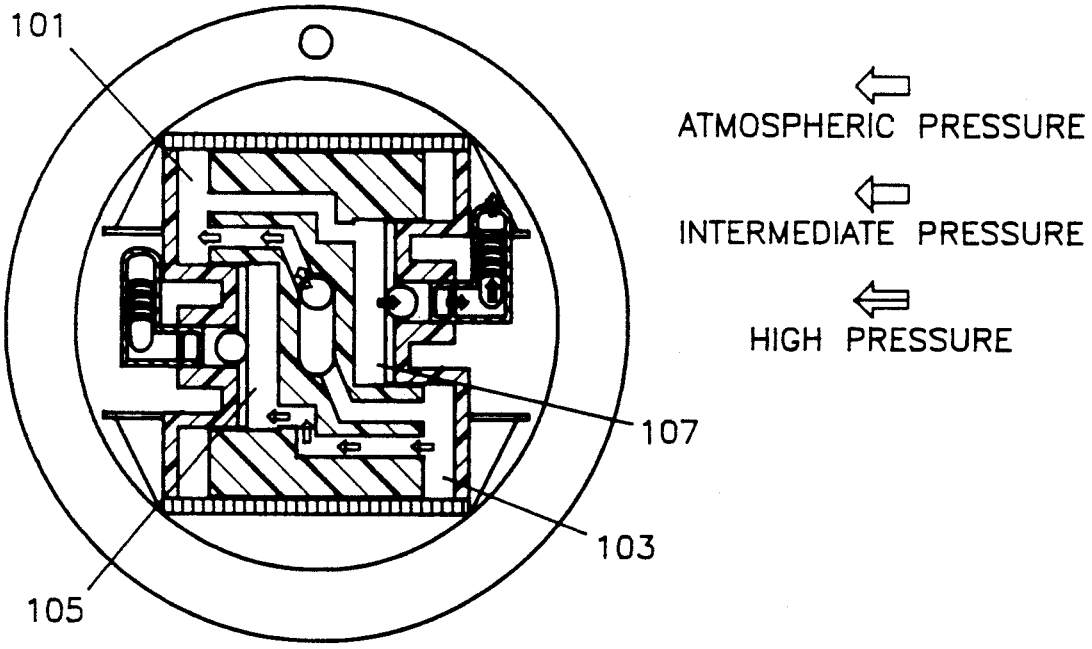

Referring now to FIG. 15*c* and 15*d*, shaft 60 has reached the top of slot 102 and main piston 100 is at its midpoint in main cylinder 82. Ambient air is drawn into main chamber 101, first stage compressed air is drawn into HPchamber 105 from right main chamber 103, and high pressure air begins to exit from HPchamber 107 through exit passage 112.

Figure 15E:
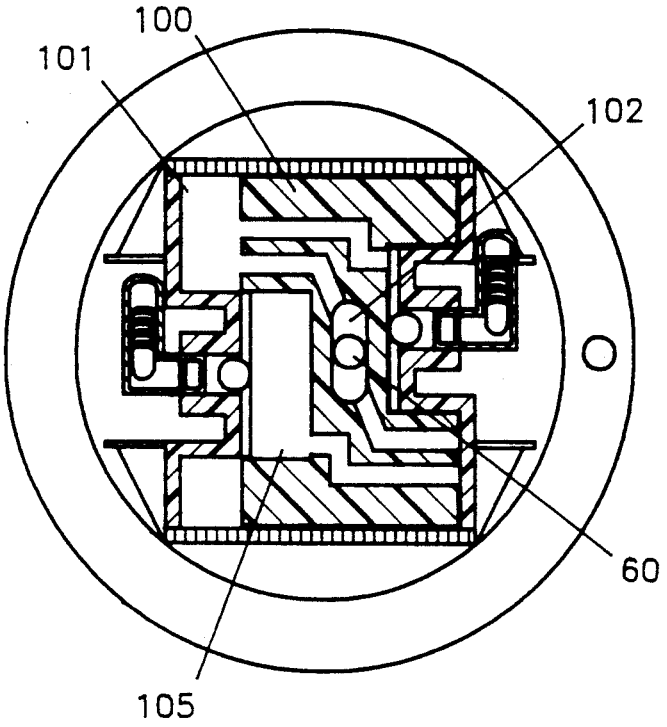
FIGS. 15*e* and 15*f* show the right stop position of the main piston and the corresponding movement of air.
Figure 15F:
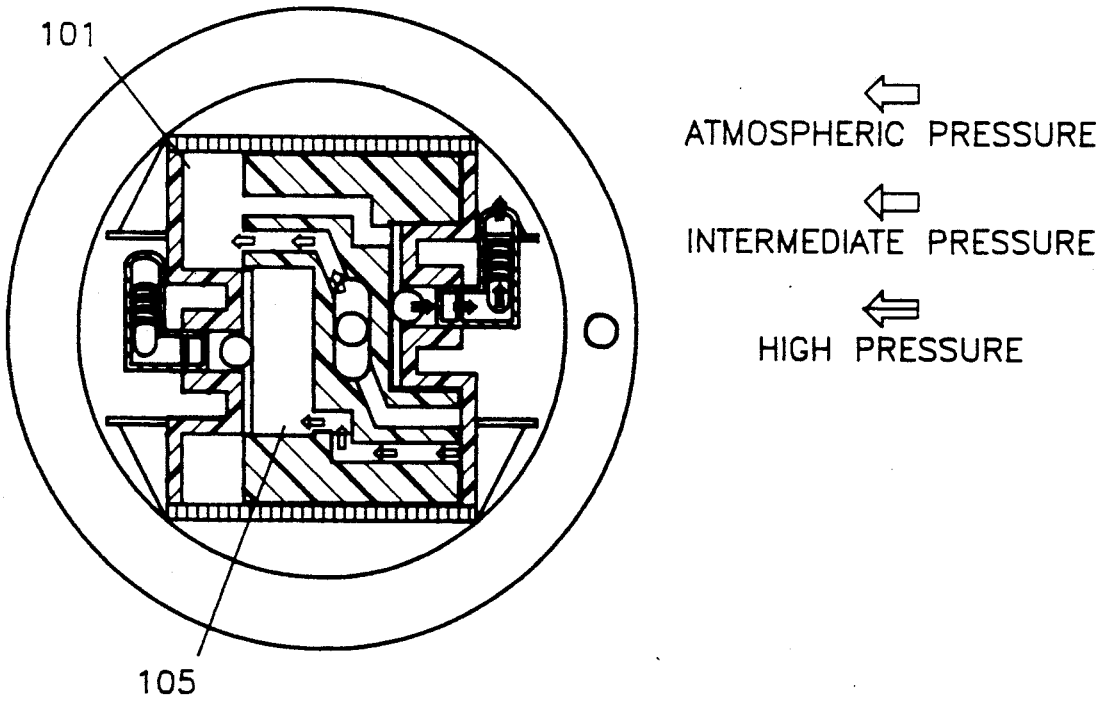

Referring now to FIGS. 15*e* and 15*f*, shaft 60 has travelled to the center of slot 102 and main piston 100 has reached the end of the right main chamber 103. Ambient air is drawn into left main chamber 101, first stage compressed air is drawn into HPchamber 105, and high pressure air is exiting from HPchamber 107.

Figure 15G:
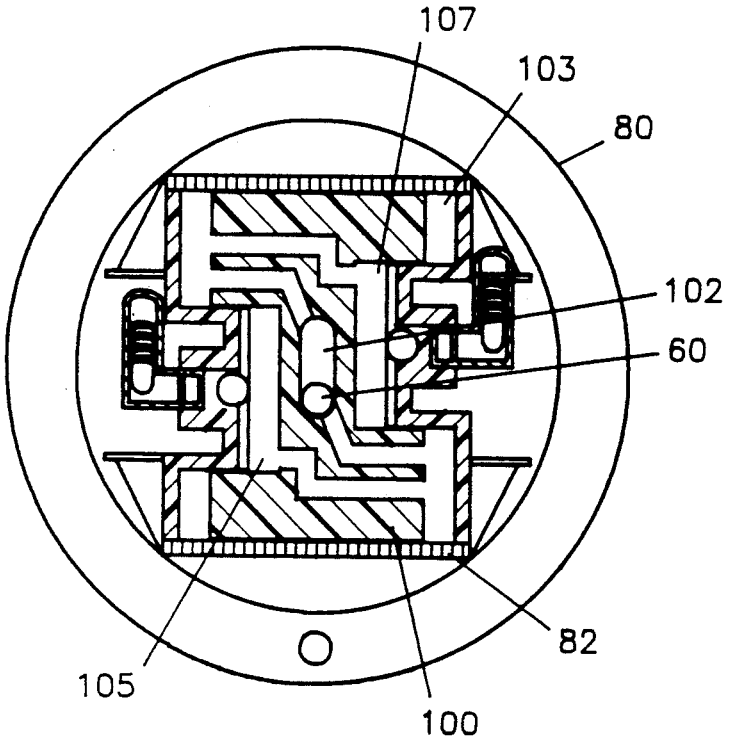
FIGS. 15*g* and 15*h*** shows the mid point of the left piston movement.
Figure 15H:
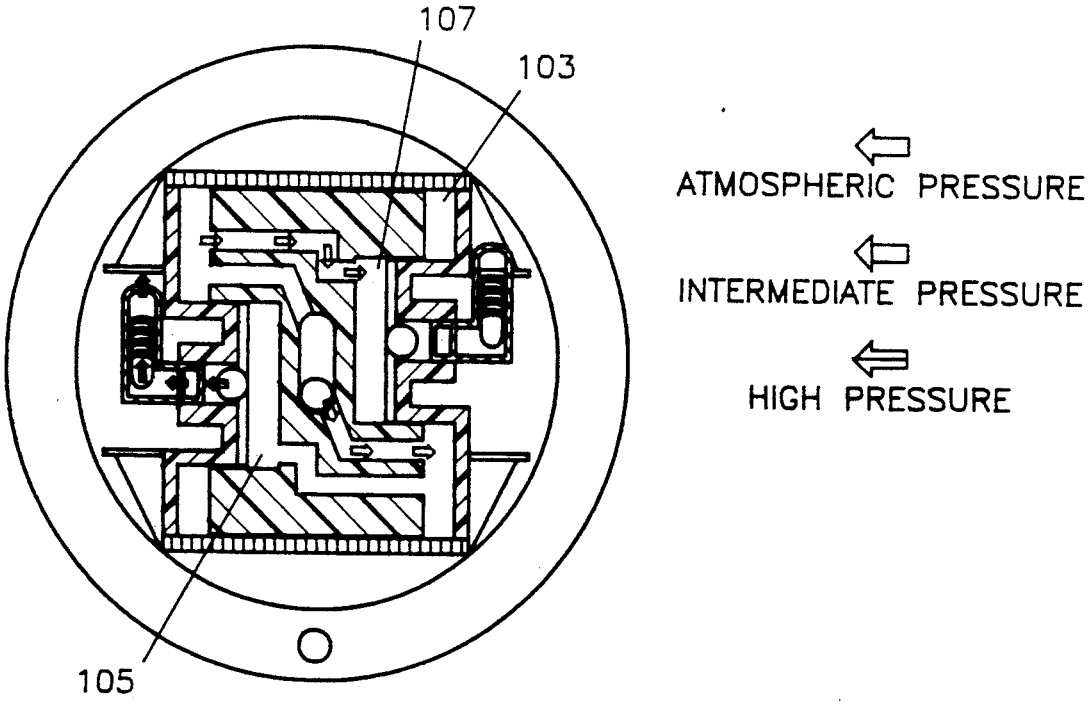

Referring now to FIGS. 15*g* and 15*h*, the cycle is completed as the shaft 60 reaches the bottom of slot 102 and the main piston returns to the midpoint of main cylinder 82. Ambient air is drawn into right main chamber 103, first stage compressed air is drawn into HPchamber 107, and high pressure air begins to exit from HPchamber 105.

The two-stage pump 80 provides for continuous pumping action, and the transferred force sequence from the larger diameter rotary sheave motion to the smaller eccentric diameter motion in the slot provides a mechanically advantaged force at the piston slot. In addition, a mechanical advantage is again gained as the main piston 100 nears the end of its stroke and the pressure of the trapped air in the chamber is at its highest level. The force necessary to move the shaft in its path against the force exerted by the trapped air varies sinusoidally. An angle may be described between a radial line passing through the center of the shaft and the shaft's center of eccentricity and the line of motion of the piston. This angle decreases to zero degrees as the piston nears the end of its path. The force necessary to move the shaft in its path decreases to zero with the sine of this angle. Thus, at a point in the compression cycle when the most compression is taking place, the most pressure is being produced, and the most work is being done and the mechanical advantage of the transfer mechanisms reaches a corresponding peak. This contributes to unexpectedly and surprisingly smooth operation of the pump 10.

As will be recognized by those skilled in the art, the three sets of passive valves operating by the differential air pressure across them, 113 and 108, control the flow of the compressed air throughout the compression cycle. When the pressure of the object to be inflated is less than that of the first stage compressed air pressure, intermediate air passes directly through the communicating HPchamber and into the exit passage without the necessity for second stage compression. As the air pressure in the object increases and becomes greater than the first stage compressed air pressure, the HPchambers begin to operate so that inflation is continuous and smooth.

Referring now to 13 another aspect of the present invention is shown including a single generally bell-shaped sheave 20'. Ball check valves are provided throughout the two-stage pump to control the passage of air. The sheave 20' and the single annular support 40' are provided with dual mating races 44' for rotation of the sheave 20'. Flanges 21' are used for mounting the oppositely wound cords 16'. A mounting plate 22' mounts over the eccentric shaft 60' and a clip device is used to secure the position of the shaft in a keyway in the plate, as previously described. Less stress is placed upon the keyway during rotation of the single sheave thereby decreasing the amount of muscular exertion required to operate the single sheave aspect of the pump.

Although the presently preferred embodiment of the invention has been illustrated and discussed herein, it is contemplated that various changes and modifications will be immediately apparent to those skilled in the art after reading the foregoing description in conjunction with the drawings. For example, some of the advantages of the present invention can be achieved in a construction having a single main chamber, a single HPchamber and a single HP piston. A two-stage pump of the present invention is also applicable to the compression of other gases besides air, such as propane, helium, oxygen with or without nitrogen, acetylene, natural gas, etc. The two-stage pump of the present invention is also applicable for other purposes besides tire filling, such as for the filling of high-pressure tanks, cooking stoves, etc. In addition, the sub-assembly encompassing the two pulley sheaves mounted on the stationary support and keyed to a common shaft with oppositely wound cords has general applicability in reducing comfortable muscular power to usable form. For instance, the sub-assembly could be used to generate electricity with a small generator having suitable controls, such as diodes and inverters to compensate for the alternating rotary motion of the common shaft. The two-stage pump may be most conveniently constructed from materials having the capability of being machined or molded to fairly close tolerances. Thus the sheaves, the central support, and the cylinder walls may be preferably formed of anodized aluminum. The common shaft and the key elements are preferably a durable material such as steel, with the leaf valves preferably formed of thin stainless steel strips with one end epoxied or otherwise fastened to the piston. The piston and the end plugs with their HPpistons, can be formed of a durable, machinable polymeric material, such as some forms of acetyl resin particularly the form known as DELRIN (a trademark of Dupont). Clearly, minor changes may be made in the form and construction of this invention and in the particular embodiments without departing from the material spirit of the invention. Accordingly, it is intended that the description herein is by way of illustration and should not be deemed limiting the invention, the scope of which being more particularly specified and pointed out by the following claims.

I claim:

1. A pump for converting muscle power of a user to mechanical power, the pump comprising:

a frame means;

pulley means rotatably mounted on the frame means;

cable means attached to the pulley means, the cable means for providing cyclical alternating pulling motions in an opposite sense, the pulley means translating the cyclical pulling motions to alternating rotation motions in an opposite sense;

a drive shaft means attached to the pulley means;

a volume displacement means mounted on the drive shaft means, the drive shaft means translating the alternating rotation motions in an opposite sense to linear motion of the volume displacement means; and valve means in the volume displacement means, the valve means responsive to the linear motion of the volume displacement means.

2. The pump of claim 1 wherein the volume displacement means comprises at least one closed cylinder and at least one piston slidingly engaged within the closed cylinder, the volume displacement means further having at least one inlet means and at least one outlet means.

3. The pump of claim 1 wherein the volume displacement means comprises:

a closed cylinder means having a first and a second end;

a main piston means slidably engaged within the cylinder means, the engagement of the main piston means creating a main chamber means at the first and second ends of the cylinder means;

a subsidiary chamber means at both ends of the main piston means;

a subsidiary piston means axially extending inwardly from the first and second ends of the cylinder means, the subsidiary piston means for reciprocation within the subsidiary chamber means;

passage means including valve means between the main chamber means and the subsidiary chamber means, the valve means for controlling volume displacement between the main chamber means and the subsidiary chamber means; and at least one inlet means and at least one outlet means, the outlet means including valve means.

4. The pump of claim 3 wherein the valve means of the passage means are one-way check valves.

5. The pump of claim 3 wherein the valve means of the outlet means are one-way ball and spring valves.

6. The pump of claim 3 wherein the rotatable sheave means comprises two sheaves mounted for rotation on the frame means, each sheave having a mating portion of a bearing race, the frame means having complementary mating portions of the bearing race for each sheave, the bearing race having ball-bearings so that the sheaves freely rotate on the frame means.

7. The pump of claim 3 wherein the pulley means comprises a rotatable sheave means oppositely wound with the cable means so that the cyclical alternating motion in an opposite sense provided by the pulling motions on the cable means causes alternating rotational motion of the sheave means on the frame means.

8. The pump of claim 4 wherein the rotatable sheave is mounted for rotation on the frame means, the frame means having at least one mating portion of a bearing race, the sheave having at least one complementary mating portion of a bearing race, the bearing race having ball-bearings so that the sheave freely rotates on the frame means.

9. The pump of claim 7 wherein the drive shaft means is mounted eccentrically with respect to an axis of rotation of the sheave means, the drive shaft means keyed to the sheave means for rotation therewith.

10. The pump of claim 9 wherein the main piston means further comprises a slot means, the drive shaft means mounted through the slot means, the eccentrically mounted drive shaft means providing a sinusoidal pattern of motion in the slot means thereby causing the main piston means to reciprocate within the cylinder means when the sheave means is caused to rotate.

11. The pump of claim 10 wherein the volume displaced is a compressible medium, the pump thereby acting as an air compressor.

12. The pump of claim 10 wherein the inlet means comprises the slot means and an axially aligned access hole in the main piston means, the access hole communicating with the slot means and with both main chamber means through at least one passage means, the passage means including a valve means at an entry to the main chamber means.

13. The pump of claim 12 wherein the inlet means is for entry of ambient air into the main chamber means.

14. The pump of claim 12 wherein the valve means at the entry to the main chamber means further comprise sensing means operable at a first pressure, the valve means between the main chamber means and the subsidiary chamber means further comprise second sensing means operable at a second pressure, and the outlet means includes exit valve means further comprises third sensing means at a third pressure.

15. A pump for pumping a gas, the pump comprising:

a closed cylinder means having a first and a second end;

a main working element slidably engaged within the cylinder means, engagement of the working element creating a common central axis and a main chamber means at the first and at the second ends of the cylinder means;

a first and a second subsidiary chamber means at a first and a second end of the working element, the first subsidiary chamber means having a first axis offset from the common central axis and the second subsidiary chamber means having a second axis diametrically opposed to the first axis of the first subsidiary chamber;

a first and a second subsidiary piston means extending inwardly from the first and second ends of the cylinder means, the first subsidiary piston means axially aligned with the first subsidiary chamber means and the second subsidiary piston means axially aligned with the second subsidiary chamber means;

slot means through the working element, the slot means for engagement with a means for reciprocating the working element;

at least two gas inlet means in the main piston means and communicating with the slot means, at least one of the inlet means extending to each main chamber means, a valve means operating at a first sensed gas pressure being associated with each inlet means;

passage means including valve means operating at a second sensed gas pressure between each of the main chamber means and a subsidiary chamber means, the valve means for controlling volume displacement between each of the main chamber means and the subsidiary means; and at least one outlet means through each subsidiary piston means, each of the outlet means including valve means operating at a third sensed gas pressure.

16. The pump of claim 15 wherein the means for reciprocating the working element comprises a drive shaft means, the drive shaft means moving around and against an outer boundary of the slot means thereby forcing the working element to reciprocate linearly.

17. The pump of claim 16 further comprising two rotatable sheave means mounted to a frame means and keyed to the drive shaft means, the sheave means oppositely wound with cord means so that a user may alternately pull the cord means to rotate the sheave means.

18. The pump of claim 16 further comprising a rotatable sheave means mounted to a frame means and keyed to the drive shaft means, the sheave means oppositely wound with cord means so that alternative rotation of the sheave means occurs when the user pulls on the cord means.

19. The pump of claim 18 wherein the drive shaft means is eccentrically keyed to the sheave means so that rotation of the sheave means causes the drive shaft means to translate the rotary motion into linear motion of the working element.

20. A manually operated device for increasing the output of user muscular power, the device comprising:

a sheave means mounted for rotation on a frame means;

cord means wound on the sheave means so that user muscular power is applied rectilinearly by alternate pulling motions on the cord means, pulling by the user at a first force producing alternating rotary motion of the sheave means;

a drive shaft means keyed to the sheave means and mounted eccentrically to the axis of rotation of the sheave means so that the alternating rotary motion of the sheave means produces alternating rotary motion of the drive shaft means about the axis of rotation of the sheave means at a second force; and a slider means driven by the second force for translating the alternating rotary motion of the drive shaft means to a sinusoidal pattern of motion to produce a third and greatest force.

21. The device of claim 20 further comprising a volume displacement means driven by the third force produced by the slider means.

* * * * *